United States Patent [19]

Beach

[11] 4,413,858

[45] Nov. 8, 1983

[54] DENTAL CHAIR

[76] Inventor: Raymond D. Beach, 8Ban-2Go, Wada-Cho, Atami-Shi, Shizuoka Prefecture, Japan, 413

[21] Appl. No.: 213,021

[22] Filed: Dec. 4, 1980

[51] Int. Cl.[3] ..... A47C 7/62

[52] U.S. Cl. ..... 297/188; 297/391; 297/458

[58] Field of Search ..... 297/188, 191, 391, DIG. 1, 297/458; 5/436, 437, 440, 464

[56] References Cited

U.S. PATENT DOCUMENTS

| | | | |
|---|---|---|---|
| 2,509,086 | 5/1950 | Eaton | 5/440 X |
| 3,156,500 | 11/1964 | Kerr | 5/436 |
| 3,198,574 | 8/1965 | Ota et al. | 297/188 X |
| 3,388,408 | 6/1968 | Blaney | 5/436 |
| 3,802,736 | 4/1974 | Valeska et al. | 297/191 |
| 3,819,232 | 6/1974 | Wagner | 297/DIG. 1 |
| 3,936,091 | 2/1976 | Rabinowitz | 297/188 |
| 4,209,907 | 7/1980 | Tsukada | 297/191 |
| 4,221,213 | 9/1980 | Gregory | 5/436 X |
| 4,266,669 | 5/1981 | Watson | 5/436 X |
| 4,311,461 | 1/1982 | Hotta et al. | 297/191 |

FOREIGN PATENT DOCUMENTS

| | | | |
|---|---|---|---|
| 2304437 | 8/1973 | Fed. Rep. of Germany | 297/188 |
| 40-16032 | 7/1965 | Japan . | |
| 48-24375 | 7/1973 | Japan . | |
| 50-393941 | 11/1975 | Japan . | |

*Primary Examiner*—James T. McCall

*Attorney, Agent, or Firm*—Bacon & Thomas

[57] ABSTRACT

The present invention is concerned with an improved construction of reclining dental chair formed to keep at any time both a dentist and a patient in steadily positional relation with one another regardless to the stature of the patient and/or the height of the upper half of his body, wherein the dentist is able to manually operate tube instruments without difficulty and at the same time the patient himself to maintain his relaxed seated or lying posture on the dental chair.

4 Claims, 7 Drawing Figures

DENTAL CHAIR

BACKGROUND OF THE INVENTION

Most of the conventional reclining type dental chairs in general use are such that the back seat thereof is selectively adjustable at limited angles, with its bent parts positioned around the underneath hip portion of the patient, and his knee joint, as is clearly illustrated in FIG. 1 of the accompanying drawings. Thus when a patient sits on the dental chair, his hip is sunken deep in the lowermost recess of the bent part, his oral cavity being not always oriented in a proper position subject to his stature and height of his upper half body. This has a result that the patient must move himself sliding along the seat of the dental chair either up or down to a position P as shown in FIG. 4 of the accompanying drawings thereby to orient his oral cavity in the position most suitable for dental treatment. Presuming a child sits on the aforementioned dental chair his head is placed on the back seat thereof to hinder the dental treatment so that a dentist is unable to freely undertake the treatment, being forced to assume an unnatural posture bending himself downward or peeping into the oral cavity of the child from one side only. Such being the case, the dentist cannot exactly manipulate treating instruments, often failing to treat the child in the most effective manner.

In the meanwhile, such tube instruments for example as a syringe or a vacuum pump are provided to be drawn out, and pulled into, the head rest of a dental chair through both sides thereof. However, the back seat of the dental chair is not held always at a fixed angle of inclination, the tube instruments must be drawn out or pulled into said sides from different positions for each use. This has still the result that a dentist cannot treat a patient in his best way by using the instruments.

STATEMENT OF OBJECTS

The present invention has been made therefore to eliminate all the above-mentioned drawbacks and disadvantages of the conventionally-known type dental chairs and has as one of its main objects the provision of an improved type dental chair comprising a substantially flat upper surface and a fixedly positioned head rest whereby, once a patient sits down on the dental chair, his shoulders are just positioned in conformity with a front edge of the chair to determine a position M of his oral cavity regardless to his stature and the height of his upper half body, thus always enabling a dentist to treat the patient in the most operative standing posture while keeping a fixedly positional relation with the oral cavity of the patient.

Another object of the invention is to provide a dental chair having a substantially flat surface whereupon a patient can lie down so that he can easily control his body in his most relaxed lying posture.

Another object of the invention is to provide a dental chair having an upper frame surface comprising a four longitudinally notched flat surface areas whereby an intermediate portion of the dental chair for positoning the hip of a patient and a rear end portion for positioning his feet or heels are both formed deeper than the other portions of the chair, wherein the aforesaid portions are filled with a thick cushioning material that enhances a cushioning effect; accordingly, some projected body portions of the patient can be softly received by the cushion whereas the joint portions of his back and legs are received in the convexed frame portions of the dental chair. Thus the supporting portions of the chair supporting the patient body can be dispersed. The result is that the projected body portions are prevented from being loaded concentratively with the body-weight of the patient himself, thus proving that the patient can be under treatment continuously for a long length of time.

Another object of the invention is to provide the construction of a dental chair wherein grip portions of tube instruments including a syringe and a vacuum pump are held in an upwardly sloped and internally inclined relation with respect to the dental chair so as to always hold the tube instruments in a fixed position. Therefore tube instruments thus held in position can be drawn out of and pulled into the dental chair smoothly by a dentist grasping the grip portion of the instruments. For instance, the dentist is able to operate the instrument just in the proper position of a patient's oral cavity merely by moving the instrument in the direction wherein he has just drawn out the same from the dental chair.

A further object of the invention is to provide a dental chair wherein a tube instrument, once drawn out, can be temporarily retained by the lower portion of a head rest and also pulled into and drawn out of the dental chair for reuse thereby conspicuously shortening the operating time of the tube instrument.

A still further object of the invention is to provide a dental chair which is lighter in weight and lower in manufacturing cost than the conventional dental chairs, being provided with a spatial room between the rear head portion of the head rest and the portions thereof corresponding to ears thereby to set the patient free of the pressure and pains to which otherwise he might be subjected while receiving dental treatment continuously for a long length of time; said head rest per se being formed by a metallic frame sheet at both sides thereof.

DETAILED DESCRIPTION OF INVENTION

Figure 1:
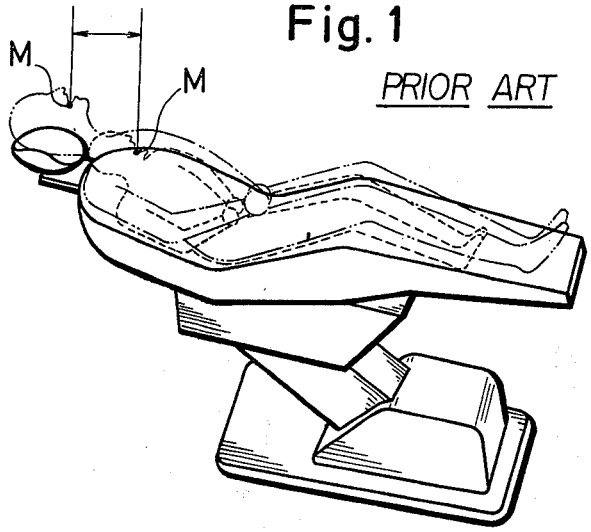
Fig. 1 PRIOR ART
FIG. 1 is a perspective view of the conventional reclining seat type dental chair.
Figure 2:
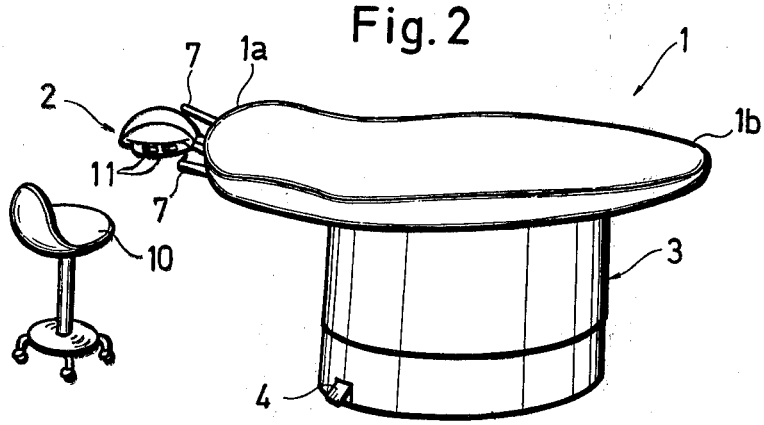
FIG. 2 is a perspective view showing a dental chair embodied in accordance with the present invention.

In the accompanying drawings referene numeral 1 generally designates a dental chair which has its upper surface area formed into a substantially flat surface shape. Said dental chair 1 is provided in its one end with a head rest 2 pivoted in vertically movable relation and mounted on a mounting stand 3 movable vertically within a limited range by a foot pedal 4.

Said flat surface shape of the dental chair 1 is made widest in the front edge of the head rest 2 and narrower toward the rear end portion thereof for supporting the feet of a patient.

A front edge 1*a* of the dental chair 1 is curved into a circular shape along each contour of the patient's shoulders while a rear edge 1*b* is curved into a substantially circular shape.

The dental chair 1 comprises a metallic frame 5 on the upper surface of which there is mounted a cushion means 6 which is made of sponge material and covered with a synthetic resin sheet 6*a*. Said metallic frame 5 has both its intermediate portion 1C for receiving the hip portion of a patient and rear portion 1D for receiving the patient's heels or feet, which is formed deeper than the other projected portons of the dental chair 1 and filled with a thick sponge sheet. In case a patient lies on the reclined dental chair 1, the muscularly resilient hip portion of his body is supported on the soft intermediate portion 1C of the chair 1 and his other portions short of muscular resiliency are supported on the convexed frame portion of the chair 1 thereby preventing the projected portion of his body from being concentratively loaded with his own body-weight, the result being that the body-weight is dispersedly supported on the dental chair 1.

Moreover, inasmuch as his bust portion is received on the convexed portion of said metallic frame 5 so as not to be sunken into the cushioning means 6, the patient P is able to be dentally treated always in his proper and comfortable lying posture without being subjected to external pressure which otherwise he might be imposed upon. On both sides of the head rest 2 around the front edge 1*a* of the dental chair 1 there is mounted a holding means 8 for holding a grip portion of the tube instrument 7 such as a syringe or a vacuum pump. In the inside of the metallic frame 5 there is housed a pulling-out means 9 for pulling out a tube 7*a* connectable to the tube instrument 7.

Figure 3:
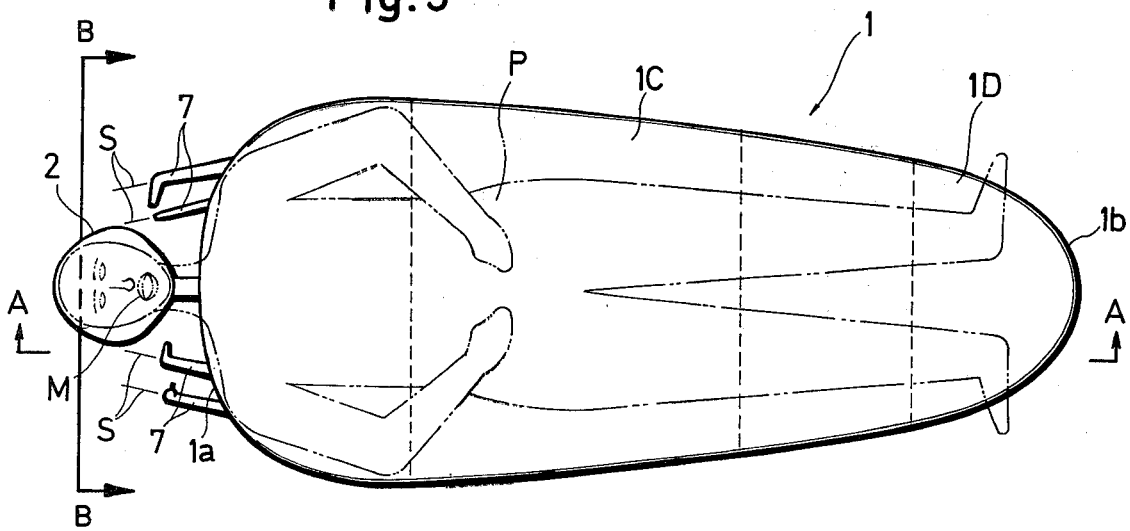
FIG. 3 is a plan view thereof.
Figure 4:
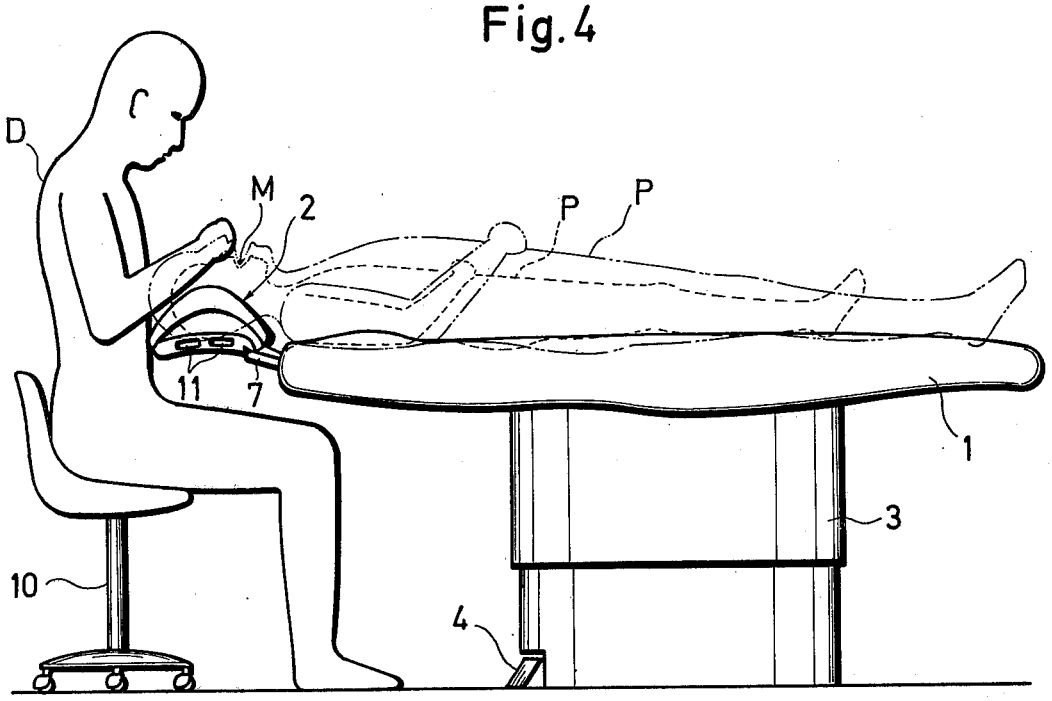
FIG. 4 is a side elevational view thereof.
Figure 5:
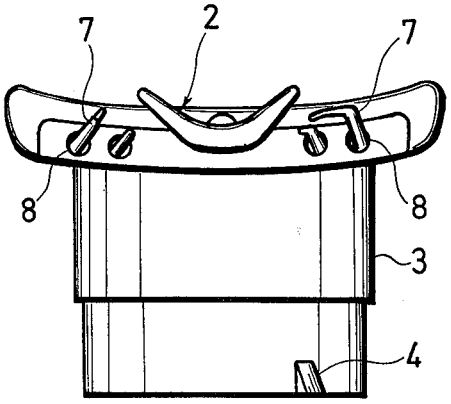
FIG. 5 is a side elevational view of the dental chair shown from the head rest side thereof.
Figure 6:
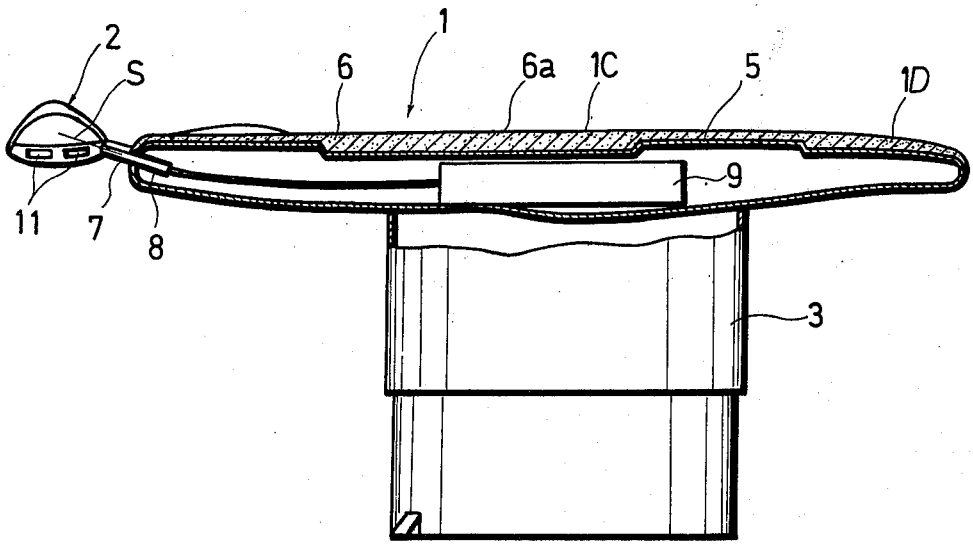
FIG. 6 is a cross sectional view taken on the line A—A of FIG. 3.
Figure 7:
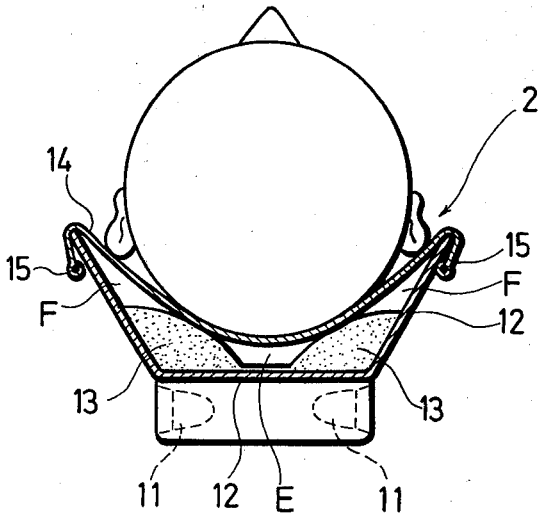
FIG. 7 is a cross sectional view taken on the line B—B of FIG. 3.

Said holding means 8 is formed into a cylindrical shape wherein the axial line S thereof is inclined upward to an opening with respect to the side elevation view shown in FIG. 6 of the accompanying drawings, said opening per se being inclined toward the head rest 2 with respect to the flat view shown in FIG. 3. Namely, the tube instrument 7 inserted into said holding means 8 is inclined in the same direction as the axial line of the latter means 8. Accordingly, a dentist D seated on a chair 10 is able to bring the tube instrument 7 exactly just over the oral cavity M of a patient P merely by pulling out the instrument 7 along the axial direction of the holding means 8, thus easily enabling the dentist D to pull the instrument 7 out of or into the holding means 8 without twisting his hand grasping the instrument 7.

Furthermore at both lower sides of the head rest 2 there is bored retaining holes 11 for temperarily retaining the tube instrument 7 when pulled out for dental treating purposes. Thus by temporarily retaining the tube instrument 7 in these retaining holes 11, the dentist D is able to use the instrument 7 as often as he wants while, during periods of non-use, positioning the instrument in the space formed downward of the head rest 2.

The foregoing head rest 2 comprises metallic frame sheet 12 whose both sides are bent up outwardly, and to whose lower sides there is internally stuck a cushioning material 13. A portion E corresponding to the headback of a patient P and an upper both sides F are both formed into a space covered with a covering means 14. Said covering means 14 is formed along its peripheral cloth edge of the frame sheet 12 with a loop portion through which a rubber band 15 is resiliently retained on the edge by expanding the former on the latter. Thus when a patient P puts his head on said head rest 2, the head is necessarily guided by the inclined frame to be positioned on the cushioning material 13. This has the result that the patient P can lie on the seat of the reclined dental chair 1 in comfortable state free of pressure against his backhead and ears.

Last but not least, the head rest 2 in accordance with the present invention is structurally simple enough to be manufactured at a very low cost, with additional advantages that the covering means 14 made of cloth material is quite agreeable to the touch of every patient and easily detachable from the frame 12 for washing purpose.

What is claimed is:

1. A dental chair comprising:

(a) an integral frame having a substantially flat horizontal upper surface and including four notched flat surface areas disposed longitudinally thereof, wherein a surface area disposed intermediate the ends of the frame and a surface area disposed at the rear portion of the frame are flattened below the remaining two flat surface areas of the frame;

(b) a cushioning material carried on the frame and including portions thereof being thicker at those surface areas flattened below the remaining surface area;

(c) a headrest supported at a front end of the chair;

(d) means positioned on at least one side of the headrest and supported for free insertion into and removable from the chair for holding at least one tube instrument;

(e) the front portion of the chair adjacent to the headrest being wider than the rear portion of the chair;

(f) the front portion of the chair having a peripheral edge curved into an arcuate configuration for conforming to the contour of the shoulders of the patient; and (g) the rear portion of the chair having a peripheral edge curved into an arcuate configuration, with the latter being smaller than the arcuate configuration of the front portion of the chair.

2. The dental chair of claim 1 wherein:

(a) the holding means are provided on both sides of the headrest;

(b) each holding means holds at least one tube instrument; and (c) each tube instrument includes a grip portion.

3. The dental chair of claim 1 wherein:

(a) the headrest is formed from a metallic sheet and includes opposed sides extending upwardly and outwardly thereof;

(b) cushioning material is disposed between the opposed sides; and (c) further including detachable means for covering the upper surface of the headrest.

4. The dental chair of claims 1, 2 or 3 wherein the headrest further includes means for temporarily retaining the tube instrument.

* * * * *